United States Patent [19]

Meier et al.

[11] Patent Number: 4,471,261

[45] Date of Patent: Sep. 11, 1984

[54] FERROMAGNETIC YOKE AND A DEFLECTION UNIT FOR A TELEVISION DISPLAY TUBE

[75] Inventors: Nicolaas F. Meier, Uden; Harm Van Duinen, Eindhoven, both of Netherlands

[73] Assignee: U.S. Philips Corporation, New York, N.Y.

[21] Appl. No.: 342,986

[22] Filed: Jan. 26, 1982

[30] Foreign Application Priority Data

Feb. 18, 1981 [NL] Netherlands ..... 8100787

[51] Int. Cl.[3] ..... H01J 29/70; H01F 7/00

[52] U.S. Cl. ..... 313/440; 335/210

[58] Field of Search ..... 313/440; 335/213, 210

[56] References Cited

U.S. PATENT DOCUMENTS 4,200,851 4/1980 Nieuwendijk et al. ..... 335/213 X

*Primary Examiner*—Palmer C. Demeo

*Attorney, Agent, or Firm*—Thomas A. Briody; William J. Streeter

[57] ABSTRACT

Annular ferromagnetic yoke for deflection units for television display tubes, having a conical inner surface which defines a longitudinal axis, and having an outer surface in which a first set of three grooves extending in the axial direction and a second set of three grooves extending in the axial direction are provided diametrically opposite each other, the grooves having accurately ground bottoms and walls which form reference faces by which the position of the axis of the yoke is fixed.

13 Claims, 5 Drawing Figures

FERROMAGNETIC YOKE AND A DEFLECTION UNIT FOR A TELEVISION DISPLAY TUBE

BACKGROUND OF THE INVENTION

1. Field of the Invention

The invention relates to an annular ferromagnetic yoke for deflection units for television display tubes, having a conical inner surface about a longitudinal axis, and having an outer surface in which a first and a second set of grooves extending in the direction of the longitudinal axis are provided symmetrically with respect to a first plane through the longitudinal axis.

2. Description of the Prior Art

Such an annular yoke is known from the article "Large screen colour television with intrinsically convergent 110° deflection" by P. G. J. Barten and J. Kaashoek published in Electronic Applications Bulletin 33, No. 2, pp. 75–88. FIG. 12 of this article shows an annular yoke which consists of two combined yoke halves which generally are obtained by breaking or cracking into two parts a sintered yoke formed as a single ring. Their halves are held together by means of two clamping springs engaging in abutting surfaces near the contact surfaces of the yoke halves extending in the direction of the longitudinal axis. These abutting surfaces are formed by the side walls of the grooves which are provided in the yoke ring during pressing, or by the side walls of ridges or wings which are pressed on the yoke ring. As is known, however, a ring is deformed during sintering so that the inner surfaces of sintered yoke rings generally are not truly rotationally symmetrical, while in addition the diameter of the yoke rings mutually varies. The presence of pressed grooves, cracking seams and winding projections and pressed ridges, respectively, leads to a deterioration of these conditions as a result of the associated variation in the wall thickness of a yoke ring. The above makes it necessary to accurately finish the inside of the sintered yoke rings. This finishing treatment (grinding) is the more complicated the larger the deformation of a sintered yoke ring. However, this is not the end of it. During assembly, the internally truly rotationally symmetrically ground ring must be centred around the remainder of the deflection unit via the outer surface which is no longer concentric with the inner surface. The advantage of grinding the inner surface is then partly lost.

Of late years the development of picture display tubes has been to a considerable extent towards constructing display tubes having ever smaller dimensions in the axial direction. For that purpose the electron beam or beams generated in an electrode system is or are deflected over an ever larger angle. Starting with a deflection angle of 70° said development has continued via a deflection angle of 90° to the nowadays usual construction having deflection angles from approximately 90° to approximately 110°. The problems associated with this development not only relate to the construction of the ferromagnetic yoke ring but also to the positioning of toroidally wound deflection coils thereon and the alignment of the yoke ring (on which coils are wound) relative to the remainder of the deflection unit. As the deflection angle increases, more stringent requirements are imposed upon the accuracy with which the yoke ring can be positioned not only in an axial direction but in particular also in a radial direction. Particularly in deflection units for combination with colour television display tubes it is important that the positioning of the deflection coils on the yoke ring and the centring of the yoke ring should occur as accurately as possible so as to minimize colour defects as a result of mislanding of an electron beam on the display screen.

It is the object of the invention to provide an annular ferromagnetic yoke of the kind mentioned in the opening paragraph which presents the possibility of accurate alignment during assembly, and/or presents the possibility of positioning deflection coils thereon accurately.

SUMMARY OF THE INVENTON

For that purpose, a yoke according to the invention is characterized in that the grooves have accurately ground limits which form reference faces by which the position of the longitudinal axis is fixed.

If during further treatments use is made only of these ground faces and no unground part of the yoke ring whatever is used as a reference, the ceramic (generally non-circular) inner surface always comes in the same favourable position with respect to the axis of the ring determined unambiguously during grinding the grooves. This leads to a considerable improvement of the accuracy in winding and centring the yoke ring without this involving an increase of the costs. Because the required grooves are ground in the sintered product, a pressed product having smooth walls may now be used as a starting material, which reduces the reject rate and the wear of the press dies considerably. Moreover, the variation in diameter of sintered rings having smooth walls is smaller than that of rings having complicatedly shaped walls so that the grinding operation of the inner surface may be omitted. The described saving in costs counterbalances the increase in costs resulting from the accurate grinding of groove sets with limits which form reference faces.

A practical construction of the annular yoke according to the invention is characterized in that each groove set comprises three grooves each of substantially rectangular cross-section and having the same pitch.

A good reference to the axis of the yoke is obtained when the reference faces according to a further embodiment of the invention are situated on two sets of planes intersecting each other at right angles.

The yoke in accordance with the invention is preferably constructed so that on at least one end the bottom and a side wall of the grooves are parallel to the longitudinal axis.

The invention also relates to a ring half for a yoke as described above and to a deflection unit for a television display tube having a yoke as described above.

The invention will now be described in greater detail, by way of example, with reference to the accompanying drawing.

DESCRIPTION OF THE PREFERRED EMBODIMENTS

Figure 1:
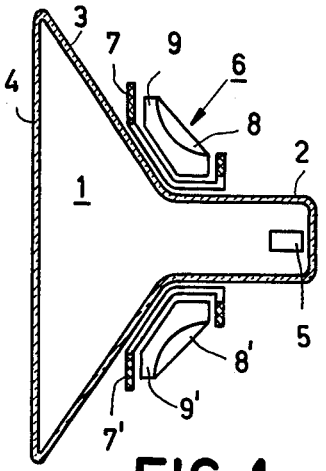
FIG. 1 is a diagrammatic longitudinal sectional view of a colour display tube having a deflection unit.

FIG. 1 is a diagrammatic longitudinal sectional view of a display tube 1 for monochrome or colour televison. It consists of a cylindrical neck portion 2 and an adjoining flared portion 3 which on its front (on the left in FIG. 1) is closed by a display screen 4. Present in the neck portion 2 is a diagrammatically shown electrode system 5 with which one electron beam (in the case of a monochrome display tube) or three electron beams extending in one plane (in the case of a colour display tube) can be generated. At the area where the neck portion 2 changes into the flared portion 3 a system of deflection coils 6 is provided on the tube 1 and surrounds the tube 1 coaxially, which system consists of a first pair of (saddle-shaped) deflection coils 7, 7' for deflecting the electron beams in the horizontal direction, a second pair of (toroidal) deflection coils 8, 8' for deflecting the electron beams in the vertical direction and a ring core 9 carrying the pair of coils 8, 8'. As shown in FIG. 1, the shape of the deflection coils 7, 7' and of the ring core 9 is adapted to the trumpet shape of the display tube 1. The horizontal deflection coils 7, 7' are situated on either side of a horizontal deflection plane which coincides with the above-mentioned plane in which the three electron beams extend. The vertical deflection coils 8, 8' are also situated on either side of said horizontal deflection plane. The vertical deflection plane is at right angles hereto and thus coincides with the plane of the drawing.

Figure 2:
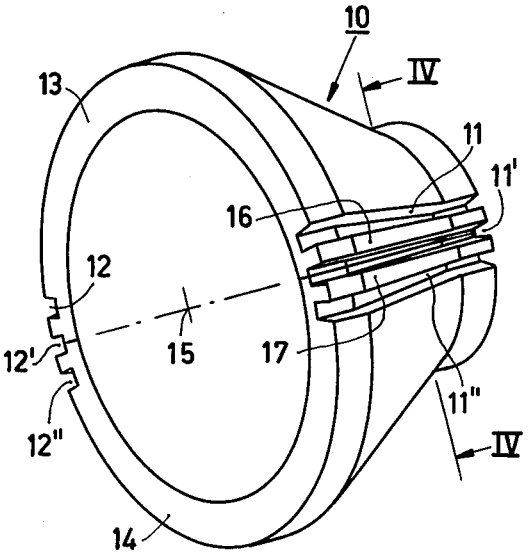
FIG. 2 is a perspective view of an annular yoke according to the invention.

The ring core 9 is manufactured from ferromagnetic material for which soft magnetic ferrites are very suitable in particular. It is flared towards the front so that it fits over the pair of deflection coils 7, 7' with a small amount of play. Reference numeral 10 in FIG. 2 indicates a perspective view of a yoke ring according to the invention.

The requirements which the winding distribution and the shape of the deflection coils 7, 7', 8, 8' must satisfy so as to obtain with simple means a good conversion of the electron beams generated by the electron guns 5, also when the beams are deflected, so that they impinge on the display screen 4 in any arbitrary place, are known and will hence not be further entered into here.

Two sets of three grooves of substantially rectangular cross-section 11, 11', 11" and 12, 12', 12", respectively, extending in the direction of the longitudinal axis 15 and having the same pitch are ground in yoke ring 10 (FIG. 2) of which grooves only the set 11, 11', 11" is fully visible. Where hereinafter there is referred to grooves 11, 11', 11", however, the same applies to the grooves 12, 12', 12". The location of the grooves 11, 11', 11" is such that a plane of symmetry of the yoke extends centrally through the centre groove 11'. In this manner the upper ring half 13 comprises a ridge 16 which is formed between the ground grooves 11 and 11' and the lower ring half 14 has a ridge 17 which is formed between the ground grooves 11' and 11". This is clearly visible in FIG. 4 which is a cross-sectional view along the line IV—IV through the yoke ring 10 of FIG. 2 when viewed from the side having the smaller diameter. The scale of FIG. 4 differs from that of FIG. 2.

Upon grinding one set of grooves, three parallel arranged grinding discs may be used which are moved through the outer surface from the end having the smaller diameter (the neck end) towards the end having the larger diameter (the conical end) along a previously determined profile, while the ring which is still not severed is clamped on a mandril the axis of which coincides as accurately as possible with the axis of the yoke ring. After grinding the first set of grooves, the mandril together with the yoke ring may be rotated 180° and the second set may be ground in the same manner. Simultaneously, or during a separate grinding process, cracking seams 19, 19' (FIG. 4) may be ground along which the yoke ring 10 may be cracked into two halves. (FIG. 5 is a diagrammatic cross-sectional view through a resulting ring half.) When the cracking seams are ground separately, the advantage is obtained that the grinding disc to be used may follow a different profile, notably a profile which is related to the inner profile—generally approximately circular—while it is not necessary for the grooves 11, 11', 11" and 12, 12', 12" to extend over the whole length of the yoke ring, which is necessary indeed for the cracking seams 19, 19'.

The grooves 11, 11', 11" and 12, 12', 12" have a substantially rectangular cross-section and are preferably ground so as to be parallel to the axis 15 both on the side having the larger diameter and on the side having the smaller diameter of the yoke ring 10. (of course within the tolerances to be obtained by grinding which in themselves are very narrow). This means that in the further processing of the yoke ring 10 two pairs of mutually parallel juxtaposed ground reference faces are available per ring half which are parallel to the axis 15 (one pair on the front side: 22, 23 and one pair on the rear side: 24, 25) and four reference faces which extend at right angles thereto (two on the front side: 26, 27 and two on the rear side 28, 29). All these faces are referred to the axis 15.

Ring half 13 (FIG. 5) is clamped in a winding machine by means of the ridge 16 formed between the grooves 11 and 11' so as to wind a coil 30 on it and ring half 14 is clamped by means of ridge 20. The presence of the said reference faces now makes it possible for the coils to be present straight opposite to each other after combining the two ring halves, use being made of clamping springs (not shown) engaging in the grooves 11 and 11" and in the grooves 12 and 12" near a central portion of their lengths so as to keep the ends of the groove free.

This also does away with the formerly usual winding studs which were pressed-in on the neck and conical sides and which presented problems in pressing (die wear) and sintering (occurrence of cracks) and could not ensure an accurate alignment of the coils because they were referred to the longitudinal axis.

Besides for winding the ring halves, the said reference faces may also be used advantageously in centring a yoke ring on a deflection unit. As a matter of fact, in that case references are available on the outside of the ring which indicates the location of the axis of the ring. By means of a tool (for example two forks) which engages against the abutting faces of the grooves 11, 11" and 12, 12", the ring can accurately be positioned so that its axis coincides with the axis of the deflection unit of which it forms part and may then be fixed. Otherwise, the yoke ring in accordance with the invention may advantageously be used in all cases in which divided yoke rings are used. This relates not only to toroidally wound yoke rings but also to unwound yoke rings which are used in combination with two sets of saddle coils.

Figure 3:
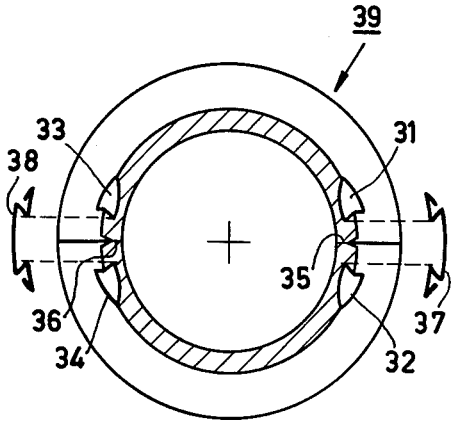
FIG. 3 PRIOR ART
FIG. 3 is a cross-sectional view through a known annular yoke.
Figure 4:
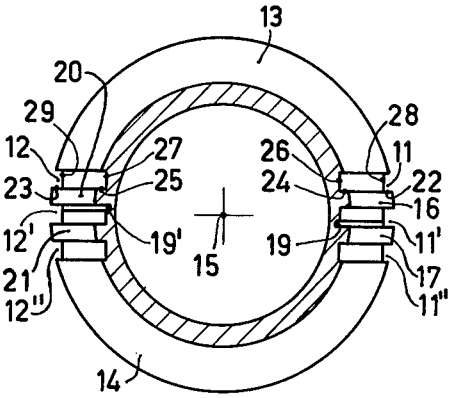
FIG. 4 is a cross-sectional view through the annular yoke of FIG. 2 (but on a different scale)
Figure 5:
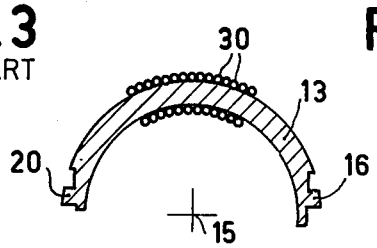
FIG. 5 is a cross-sectional view through a ring half in accordance with the invention.

For comparison with the earlier situation serves FIG. 3 which is a diagrammatic cross-sectional view similar to that of FIG. 4 through a yoke ring of a known construction having previously pressed-in grooves 31, 32 33, 34 so that so-called "ears" 35, 36 are formed which serve as connection points for clamping springs 37, 38 with which the halves of the ring 39 are held together.

What is claimed is:

1. In an annular ferromagnetic yoke for deflection units for television display tubes, having a conical inner surface about a longitudinal axis, and having an outer surface in which a first and a second set of grooves extending in the direction of the longitudinal axis are provided symmetrically with respect to a first plane through the longitudinal axis, the improvement wherein the grooves have accurately ground limits which form reference faces by which the position of the longitudinal axis is fixed.

2. A yoke as claimed in claim 1, wherein each set of grooves comprises three grooves each of substantially rectangular cross-section and having the same pitch.

3. A yoke as claimed in claim 1 or 2, wherein the reference faces are situated on two sets of planes intersecting each other at right angles.

4. A yoke as claimed in claim 1 or 2 wherein on at least one end the bottom and a side wall of the grooves are parallel to the longitudinal axis.

5. A yoke as claimed in claim 1 or 2 wherein said yoke consists of two ring halves which are held together by clamping springs each engaging in a groove of the first set and in a groove of the second set present on either side of the connection surfaces of the individual ring halves.

6. A yoke as claimed in claim 5, wherein the clamping springs are provided near the centre of the yoke so as to keep the ends of the grooves free to serve as a reference in assembling the yoke.

7. A yoke as claimed in claim 2 wherein the yoke is divided into two parts along planes extending through the central grooves of each set of grooves.

8. A yoke as claimed in claim 3 wherein on at least one end the bottom and a side wall of the grooves are parallel to the longitudinal axis.

9. A yoke as claimed in claim 3 wherein said yoke consists of two ring halves which are held together by clamping springs each engaging in a groove of the first set and in a groove of the second set present on either side of the connection surfaces of the individual ring halves.

10. A yoke as claimed in claim 4 wherein said yoke consists of two rings halves which are held together by clamping springs each engaging in a groove of the first set and in a groove of the second set present on either side of the connection surfaces of the individual ring halves.

11. A yoke as claimed in claim 3 wherein the yoke is divided into two parts along planes extending through the central grooves of each set of grooves.

12. A yoke as claimed in claim 4 wherein the yoke is divided into two parts along planes extending through the central grooves of each set of grooves.

13. A yoke as claimed in claim 5 wherein the yoke is divided into two parts along planes extending through the central grooves of each set of grooves.

* * * * *